US012104338B2

(12) United States Patent
Yu et al.

(10) Patent No.: US 12,104,338 B2
(45) Date of Patent: Oct. 1, 2024

(54) COMBINED TYPE FLEXIBLE GLASS NET SYSTEM USED FOR PROTECTION AGAINST FULL-PARTICLE FALLING ROCKS ON PLANK ROADS IN SCENIC SPORTS AND MOUNTING METHOD THEREOF

(71) Applicant: Southwest Jiaotong University, Chengdu (CN)

(72) Inventors: Zhixiang Yu, Chengdu (CN); Lijun Zhang, Chengdu (CN); Gaohong Ye, Chengdu (CN); Liru Luo, Chengdu (CN); Xu Hu, Chengdu (CN); Xin Qi, Chengdu (CN); Lei Zhao, Chengdu (CN); Shichun Zhao, Chengdu (CN)

(73) Assignee: Southwest Jiaotong University, Chengdu (CN)

( * ) Notice: Subject to any disclaimer, the term of this patent is extended or adjusted under 35 U.S.C. 154(b) by 459 days.

(21) Appl. No.: 17/485,427

(22) Filed: Sep. 26, 2021

(65) Prior Publication Data

US 2022/0220679 A1 Jul. 14, 2022

(30) Foreign Application Priority Data

Jan. 11, 2021 (CN) ..... 202110027856.8

(51) Int. Cl.
*E01F 7/04* (2006.01)
*E02D 17/20* (2006.01)
*E04H 17/04* (2006.01)

(52) U.S. Cl.
CPC ..... *E01F 7/045* (2013.01); *E02D 17/202* (2013.01); *E04H 17/05* (2021.01)

(58) Field of Classification Search
CPC .... E01F 7/00; E01F 7/04; E01F 7/045; E04H 17/05
See application file for complete search history.

(56) References Cited

U.S. PATENT DOCUMENTS 5,299,781 A * 4/1994 Barrett ..... E01F 7/045 256/12.5
8,079,571 B2 * 12/2011 Nishita ..... E01F 7/045 256/45
9,309,636 B2 * 4/2016 Wyllie ..... E01F 7/045

FOREIGN PATENT DOCUMENTS

KR 10-1094247 * 12/2011 ..... E01F 7/04

* cited by examiner

*Primary Examiner* — Michael P Ferguson
(74) *Attorney, Agent, or Firm* — Bayramoglu Law Offices LLC

(57) ABSTRACT

A combined type flexible glass net system used for protection against full-particle falling rocks on plank roads in scenic spots includes a supporting layer, an intercepting throwing layer and a flexible glass net isolating layer, wherein the supporting layer is longitudinally arranged above a protective area along a mountain, and includes a supporting steel frame and an oscillating type supporting rod; the intercepting throwing layer is supported on the supporting layer, and includes metal meshes, an along-cross-slope lower connecting rope, an along-cross-slope upper connecting rope, an along-slope connecting rope and a reinforcing rope; and the flexible glass net isolating layer includes glass plates, glass net supporting cables and a hoop type hinged piece, wherein the glass plates are connected to the glass net supporting cables through the hoop type hinged piece, and the glass net supporting cables are hung below the supporting steel frame.

11 Claims, 4 Drawing Sheets

Module

Module

COMBINED TYPE FLEXIBLE GLASS NET SYSTEM USED FOR PROTECTION AGAINST FULL-PARTICLE FALLING ROCKS ON PLANK ROADS IN SCENIC SPORTS AND MOUNTING METHOD THEREOF

CROSS REFERENCE TO THE RELATED APPLICATIONS

This application is based upon and claims priority to Chinese Patent Application No. 202110027856.8, filed on Jan. 11, 2021, the entire contents of which are incorporated herein by reference.

TECHNICAL FIELD

The invention relates to the field of side slope protection technologies, and in particular, to a combined type flexible glass net system used for protection against full-particle falling rocks on plank roads in scenic spots.

BACKGROUND

Plank roads in canyon-type and mountain-type scenic spots are often threatened by falling rocks, which not only hinder passage, but also seriously endanger lives of passing tourists. When colliding with the mountain, the falling rocks may break or cause a slope surface to break to form more rock masses with high energy and different shapes, thereby increasing the hazard of the falling rocks. Therefore, protection of falling rocks in scenic spots needs to consider interception and protection of full-size falling rocks. Plank roads in scenic spots are usually narrow and winding, and therefore, it is inconvenient to transport construction materials there and it is difficult to carry out large-scale construction operations. In addition, for the protection of falling rocks in scenic spots, construction of protective facilities adopted also needs to consider suitability of the human landscapes and integration of the ecological environment.

The traditional passive flexible protection net system, active net system, flexible shed hole or flexible canopy all use two layers of metal meshes with different pore sizes to intercept the falling rocks, which cannot solve the technical problem of interception and protection of full-size falling rocks, and lacks a landscape adaptation function. The small-size falling rocks penetrating through mesh holes often endanger lives of passing tourists, and affect the landscapes.

In view of this, persons skilled in the art devote to flexible falling rock protection facilities with suitability of the human landscapes and integration of the ecological environment, construction and maintenance convenience, and full-size falling rock protection performance.

SUMMARY

The objective of the present invention is to provide a combined type flexible glass net system used for protection against full-particle falling rocks on plank roads in scenic spots. The system comprehensively considers suitability of the human landscapes and integration of the ecological environment in design. Due to the combined type protection effect, large-size falling rocks can be prevented and controlled through inclined metal meshes, and a flexible glass net can block the crushed rocks. The system realizes comprehensive prevention and control effect of "guiding out and throwing large-size falling rocks and isolating and protecting small-size stones", is easy to mount and has unit modularity features: When a component fails, the system can be put into use again only if it is partially replaced.

To achieve the objective, the present invention adopts the following technical solution:

In one aspect, a combined type flexible glass net system used for protection against full-particle falling rocks on plank roads in scenic spots include a supporting layer, an intercepting throwing layer and a flexible glass net isolating layer.

The supporting layer is longitudinally arranged above a protective area along a mountain, and includes a supporting steel frame and an oscillating type supporting rod, where the end parts of the supporting steel frame and the oscillating type supporting rod are hinged on the mountain or the slope surface through a hinged support capable of adjusting a pitch angle.

The intercepting throwing layer is supported on the supporting layer, and includes metal meshes, an along-cross-slope lower connecting rope, an along-cross-slope upper connecting rope, an along-the-slope connecting rope and a reinforcing rope, where the along-cross-slope lower connecting rope, the along-cross-slope upper connecting rope and the reinforcing rope are arranged parallel to the mountain; the along-cross-slope lower connecting rope, the along-cross-slope upper connecting rope and the along-the-slope connecting rope define a supporting boundary, and the metal meshes are hung on the supporting boundary in a penetrating mode.

The flexible glass net isolating layer includes glass plates, glass net supporting cables and a hoop type hinged piece, where the glass plates are connected to the glass net supporting cables through the hoop type hinged piece, and the glass net supporting cables are hung below the supporting steel frame.

Further, the hoop type hinged piece is a sleeve component with clamping mechanisms at the two sides, a sleeve is arranged on the glass net supporting cables in a penetrating mode, and the glass plates are clamped by the clamping mechanisms.

Further, the glass net supporting cables include a longitudinal supporting rope and a transverse supporting rope, one end of the transverse supporting rope is connected to an extending-out end of the supporting steel frame, and the other end of the transverse supporting rope is connected to the hinged support; and the two ends of the longitudinal supporting rope are separately connected to the transverse supporting rope.

Further, the along-cross-slope lower connecting rope passes through a sliding joint at the top end of the supporting steel frame, and the two ends of the along-cross-slope lower connecting rope are anchored to the mountain or the slope surface; the two ends of the along-cross-slope upper connecting rope are anchored to the mountain, and the middle part of the along-cross-slope upper connecting rope is anchored to the slope surface or the mountain through a sliding support; and the reinforcing rope passes through the sliding joint at the top end of the oscillating type supporting rod, and the two ends thereof are anchored to the mountain.

Further, one end of the along-the-slope connecting rope is fixed onto the supporting steel frame, the middle part of the along-the-slope connecting rope is in sliding connection to the oscillating type supporting rod, and the other end of the along-the-slope connecting rope is connected to the sliding support.

Further, the hoop type hinged piece includes an inner flat plate hinged piece A and an outer flat plate hinged piece B;

the inner flat plate hinged piece A includes a sleeve for accommodating the glass net supporting cable and a bolt clamping mechanism; and the outer flat plate hinged piece B covers the sleeve, and is equipped with a bolt clamping mechanism.

Further, pitch angles and overhanging lengths of the supporting steel frame and the oscillating type supporting rod can be adjusted according to protective needs, and gradient adjustment of the metal meshes is realized by adjusting the pitch angle of the oscillating type supporting rod.

Further, the oscillating type supporting rod is a piston rod or profile steel; the structural form of the supporting steel frame includes, but not limited to a truss structure and a profile steel structure, and the extending-out end of the supporting steel frame is fixed by a traction rope and the along-the-slope connecting rope.

Alternatively, the application further protects a mounting method of the combined type flexible glass net system used for protection against full-particle falling rocks on the plank road, including the following steps:

a, constructing a supporting layer base according to general layout of the system, and mounting a supporting steel frame and an oscillating type supporting rod, where the supporting steel frame is hinged with a pin of the oscillating type supporting rod, and an overhanging length and a pitch angle of the supporting layer structure are designed according to needs;

b, mounting an along-the-slope connecting rope of the supporting steel frame, connecting one end of the along-the-slope connecting rope to the top end of the extending-out side of the supporting steel frame so as to pass through a sliding device on the end part of the oscillating type supporting rod, anchoring the other end of the along-the-slope connecting rope on the mountain for stabilizing and pulling the supporting layer, and sharing one along-the-slope connecting rod or two along-the-slope connecting rods between adjacent modules according to protective needs;

c, mounting an along-cross-slope lower connecting rope, an along-cross-slope upper connecting rope and a reinforcing rope on an intercepting throwing layer, making the along-cross-slope lower connecting rope pass through a sliding device at the top end of the supporting steel frame of each module, and anchoring the two ends of the along-cross-slope lower connecting rope on a mountain; anchoring the middle part of the along-cross-slope upper connecting rope on the slope surface or the mountain through a sliding support of each module in sections, and anchoring the outermost side of the along-cross-slope upper connecting rope to the mountain; making the reinforcing rope pass through the sliding device at the top of the oscillating type supporting rod, and obliquely pulling and anchoring outer-extending sections of the reinforcing rope at the outermost side on the mountain;

d, mounting metal meshes, connecting the metal meshes, the along-cross-slope lower connecting rope, the along-cross-slope upper connecting rope, the reinforcing rope and the along-the-slope connecting rope through connectors, where metal meshes of the adjacent modules can be connected to the same along-the-slope connecting rope or connected onto different along-the-slope connecting ropes according to protective needs; and e, mounting a flexible glass net isolating layer, weaving the glass net supporting cable into a net shape, and hanging on the supporting steel frame and the hinged support, and connecting the glass plate to the hoop type hinged piece through hoop method construction.

Further, the hoop method construction in the step e includes: making the inner flat plate hinged piece A of the hoop type hinged piece pass through the glass net supporting cable, and connecting the end part of the inner flat plate hinged piece A to a glass plate tightening bolt; covering the inner flat plate hinged piece A with an outer flat plate hinged piece B of the hoop type hinged piece, connecting the other end of the outer flat plate hinged part B to an adjacent glass plate, and then tightening the bolt.

The present invention has the following beneficial effects:

(1) The flexible glass net in the present invention, made of a glass material, has a good landscape view; and the system comprehensively considers suitability of the human landscapes and integration of the ecological environment in design, and is suitable for protection against full-particle falling rocks on plank roads in scenic spots.

(2) A three-layer combined type structure of the present invention is equipped with a supporting layer for supporting the system, adjusting forms and paving angles of the metal meshes and suspending the flexible glass net, is equipped with an intercepting throwing layer to buffer thrown-out large-size falling rocks, and is equipped with the flexible glass net isolating layer for isolating and protecting small-size stones. The whole combined type system solves a phenomenon that an existing flexible protective system is difficult in clearing falling rocks, and realizes full-size falling rock protection.

BRIEF DESCRIPTION OF THE DRAWINGS

In order to explain the technical solutions in the embodiments of the present invention or the prior art more clearly, the drawings used in the embodiments or the prior art will be briefly introduced below. Obviously, the drawings in the following description are some embodiments of the present invention. For a person of ordinary skill in the art, other drawings can be obtained based on these drawings without paying creative labor.

FIG. 5 is a mounting diagram showing a sliding support of a combined type flexible glass net system used for protection against full-particle falling rocks on plank roads in scenic spots provided in embodiments of the present invention;

Figure 1:
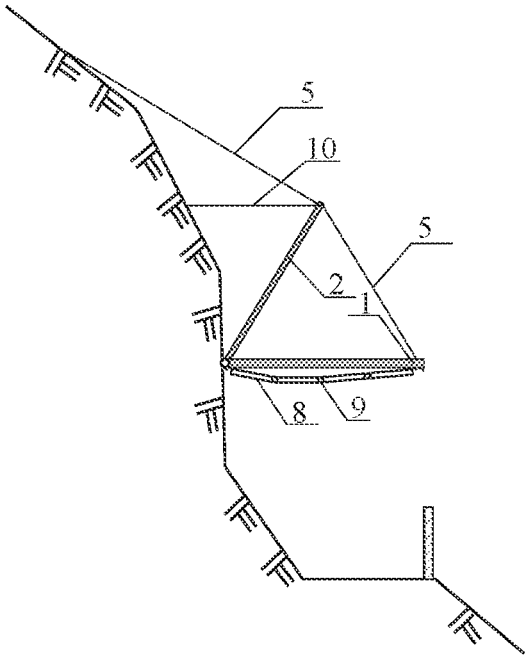
FIG. 1 is a side view diagram of a combined type flexible glass net system used for protection against full-particle falling rocks on plank roads in scenic spots provided in embodiments of the present invention.

Names of structures corresponding to reference numerals in the figures are as follows:

1. supporting steel frame; 2. oscillating type supporting rod; 3. along-cross-slope lower connecting rope; 4. along-cross-slope upper connecting rope; 5. along-the-slope connecting rope; 6. glass net supporting cable; 7. metal mesh; 8. glass plate; 9. hoop type hinge rope; 10. reinforcing rope; 11. hinged support; 12. traction rope; and 13. sliding support.

DETAILED DESCRIPTION OF THE EMBODIMENTS

In order to make the objectives, technical solutions, and advantages of the embodiments of the present invention clearer, the technical solutions in the embodiments of the present invention will be described clearly and completely in combination with the drawings in the embodiments of the present invention. Obviously, the described embodiments are part of, but not all of, the embodiments of the present invention. Based on the embodiments in the present invention, all other embodiments obtained by a person of ordinary skill in the art without creative efforts shall fall within the protection scope of the present invention.

Figure 2:
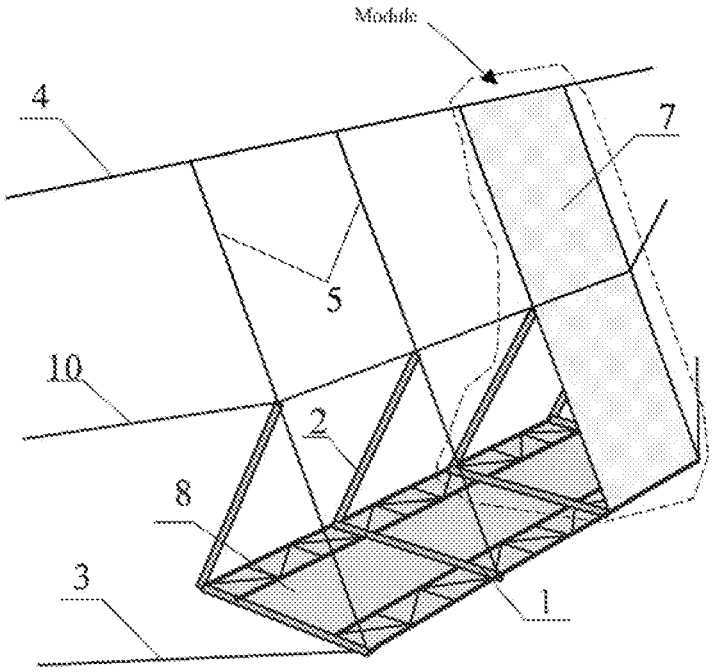
FIG. 2 is an axial-side diagram (showing a rightmost cross mesh) of a combined type flexible glass net system used for protection against full-particle falling rocks on plank roads in scenic spots provided in embodiments of the present invention.
Figure 3:
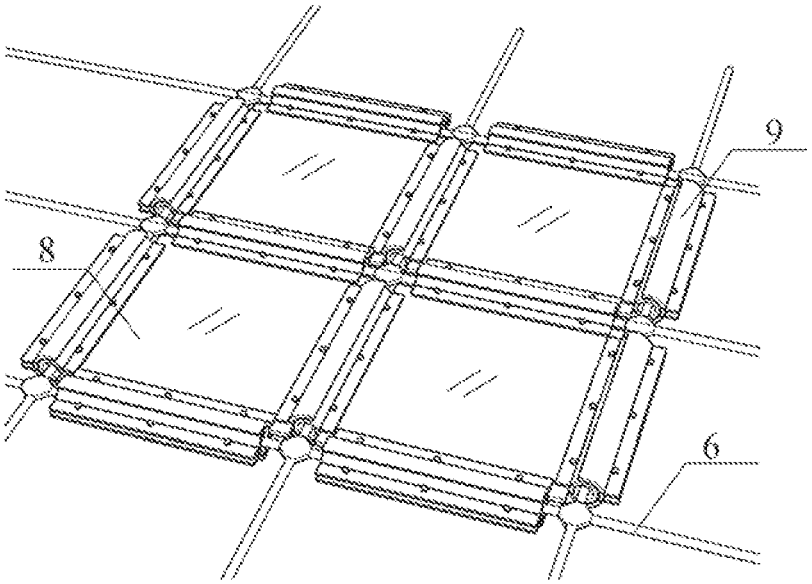
FIG. 3 is a schematic diagram showing a flexible glass net isolating layer of a combined type flexible glass net system used for protection against full-particle falling rocks on plank roads in scenic spots provided in embodiments of the present invention.
Figure 4:
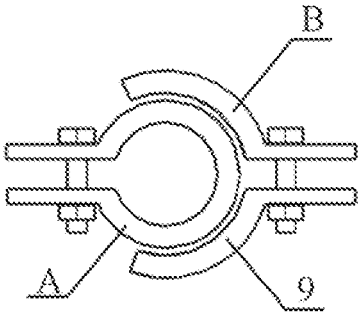
FIG. 4 is a schematic diagram showing a hoop type hinged piece of a combined type flexible glass net system used for protection against full-particle falling rocks on plank roads in scenic spots provided in embodiments of the present invention.
Figure 5:
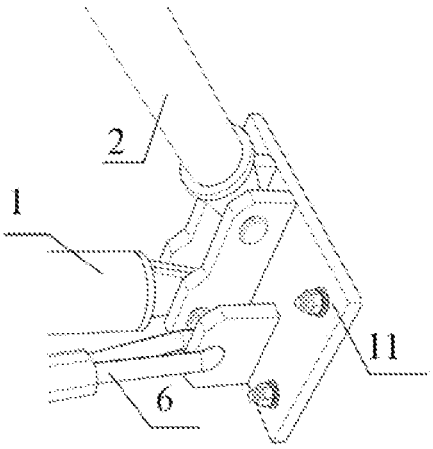
FIG. 5 is a schematic diagram showing a hinged support of a combined type flexible glass net system used for protection against full-particle falling rocks on plank roads in scenic spots provided in embodiments of the present invention.
Figure 6:
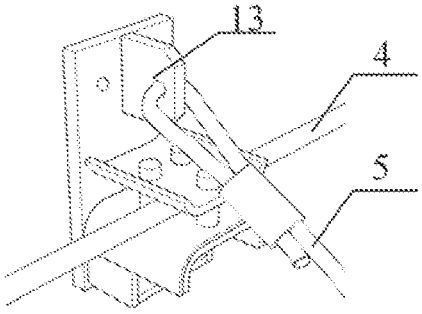
Figure 7:
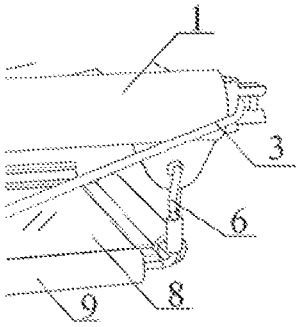
FIG. 7 is an end part connecting diagram showing a supporting steel frame of a combined type flexible glass net system used for protection against full-particle falling rocks on plank roads in scenic spots provided in embodiments of the present invention.
Figure 8:
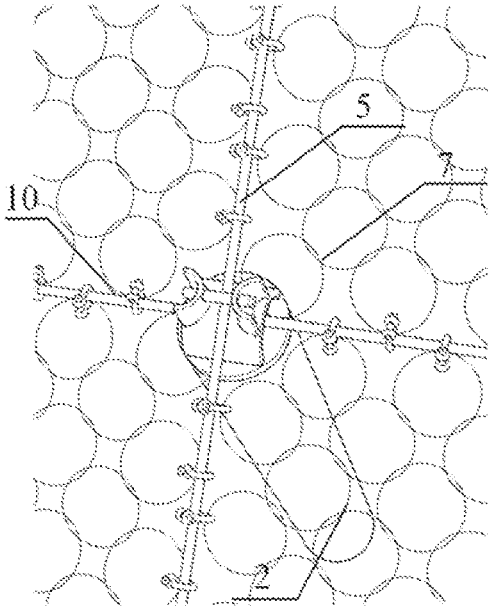
FIG. 8 is a mounting diagram showing an oscillating type supporting rod and an along-the-slope connecting rope of a combined type flexible glass net system used for protection against full-particle falling rocks on plank roads in scenic spots provided in embodiments of the present invention.
Figure 9:
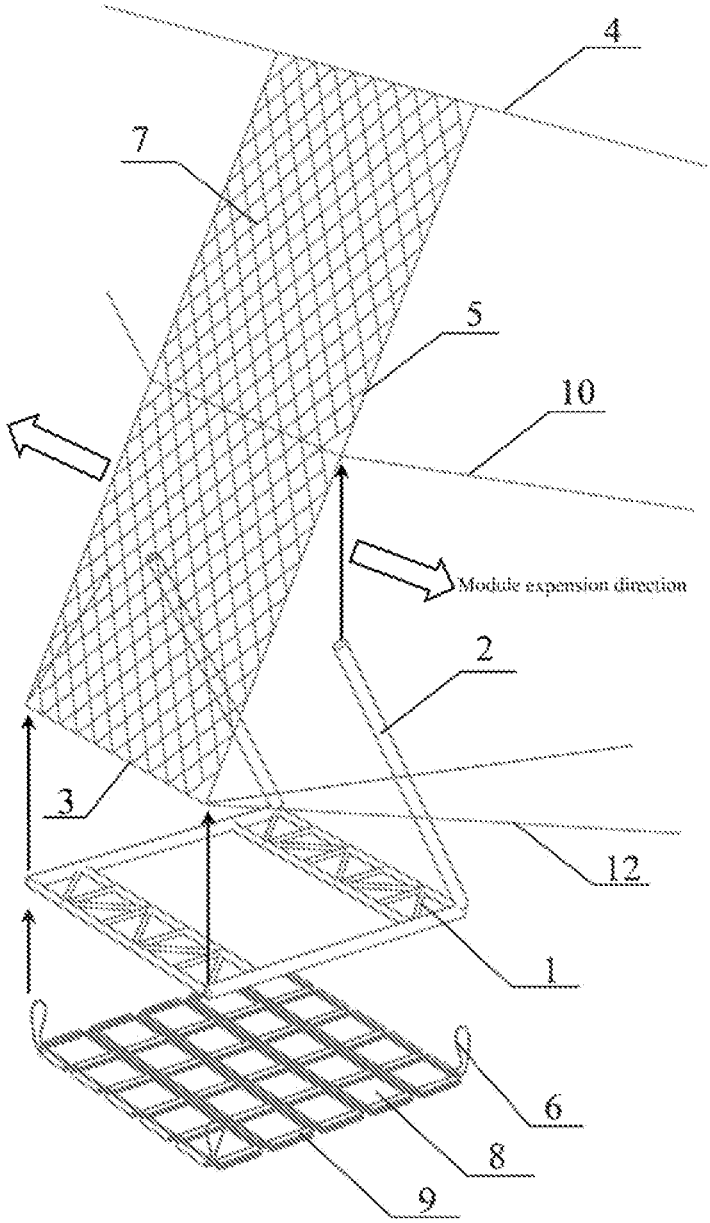
FIG. 9 is a mounting diagram showing of a combined type flexible glass net system used for protection against full-particle falling rocks on plank roads in scenic spots provided in embodiments of the present invention.

As shown in FIG. 1 to FIG. 9, the combined type flexible glass net system used for protection against full-particle falling rocks on plank roads in scenic spots includes the supporting steel frame 1, the oscillating type supporting rod 2, the along-cross-slope lower connecting rope 3, the along-cross-slope upper connecting rope 4, the along-the-slope connecting rope 5, the glass net supporting cables 6, the metal meshes 7, the glass plates 8, the hoop type hinged piece 9, the reinforcing rope 10, the hinged support 11, the traction rope 12 and the sliding support 13.

The system is combined by a supporting layer, an intercepting throwing layer and a flexible glass net isolating layer. The supporting layer includes the supporting steel frame 1, the oscillating type supporting rod 2, and is longitudinally arranged above a protective area along a mountain; the end part of the supporting layer structure is hinged on the mountain or a slope surface through the hinge support 11 capable of adjusting a pitch angle, and the pitch angle and the overhanging length of the supporting layer structure can be adjusted according to protective needs; the oscillating type supporting rod 2 can be a profile steel component, and is in sliding connection to one end of the along-the-slope connecting rope 5; the structural form of the supporting steel frame 1 can be a truss structure, and an overhanging end thereof is fixed by the traction rope 12 and the along-the-slope connecting rope 5; and the along-cross-slope lower connecting rope 3, the along-cross-slope upper connecting rope 4 and the along-the-slope connecting rope 5 define a supporting boundary. One end of the along-the-slope connecting rope 5 is fixed onto the supporting steel frame 1, the middle part of the along-the-slope connecting rope 2 is in sliding connection to the oscillating type supporting rod 2, and the other end of the along-the-slope connecting rope is connected to the sliding support 13.

In the embodiment of the present invention, the flexible glass net isolating layer includes glass plates 8, glass net supporting cables 6 and the hoop type hinged piece 9, where the glass plates 8 are connected to the glass net supporting cables 6 through the hoop type hinged piece 9, and the glass net supporting cables 6 are hung below the supporting steel frame 1. Further, the glass net supporting cables 6 are divided into a longitudinal supporting cable and a transverse supporting cable; in an overhanging direction of the supporting steel frame 1, one end of the transverse supporting cable is connected to the extending-out end of the supporting steel frame 1, and the other end of the transverse supporting cable is connected to the hinged support 11; the longitudinal supporting cable is perpendicular to the overhanging direction of the structure, and the two ends of the longitudinal supporting cable are separately connected to the transverse supporting cable; the glass plate 8 is hinged onto the glass net supporting cable 6 through the hoop type hinged piece 9; the hoop type hinged piece 9 sleeves the glass net supporting cables 6 in a penetrating mode, and the two sides of the hoop type hinged piece 9 are clamped with the glass plates 8; and preferably, the hoop type hinged piece 9 is a flat plate hinged piece.

In one embodiment of the present invention, the hoop type hinged piece 9 includes an inner flat plate hinged piece A and an outer flat plate hinged piece B; the inner flat plate hinged piece A includes a sleeve for accommodating the glass net supporting cable 6 and a bolt clamping mechanism; and the outer flat plate hinged piece B covers the sleeve, and is equipped with a bolt clamping mechanism.

In the embodiments of the present invention, the intercepting throwing layer includes metal meshes 7, the along-cross-slope lower connecting rope 3, the along-cross-slope upper connecting rope 4, the along-the-slope connecting rope 5 and the reinforcing rope 10. The metal meshes 7 are hung on the supporting boundary in a penetrating mode, and gradient adjustment of the metal meshes 7 is realized by adjusting a pitch angle of the oscillating type supporting rod 2. Further, the along-cross-slope lower connecting rope 3 passes through a sliding joint at the top end of the supporting steel frame 1, can form friction sliding along the supporting steel frame 1, and the outermost side thereof can extend out to be anchored to the mountain or the slope surface; the along-cross-slope upper connecting rope 4 is parallel to the mountain, the outermost side is anchored to the mountain, and the middle part can be anchored to the slope surface or the mountain through the sliding support 13 in sections; and the reinforcing rope 10 can slide along the oscillating type supporting rod 2, passes through the metal meshes 7, and the two ends thereof are anchored to the mountain.

In practical mounting, the supporting layer structure is used for adjusting a net surface form and hanging the flexible glass net. The supporting steel frame is hinged with a pin of the oscillating type supporting rod through the hinged support, and an overhanging length and a pitch angle of the supporting layer structure are designed according to needs. Meanwhile, the along-the-slope connecting rope of the supporting steel frame is mounted, one end of the along-the-slope connecting rope is connected to the top end of the extending-out side of the supporting steel frame and the other end of the along-the-slope connecting rope is anchored on the mountain for stabilizing and pulling the supporting layer, and one along-the-slope connecting rope or two along-the-slope connecting ropes are shared between adjacent modules according to protective needs. Then, the along-cross-slope lower connecting rope, the along-cross-slope upper connecting rope and the reinforcing rope of the intercepting throwing layer are mounted; the along-cross-slope lower connecting rope passes through the sliding device at the top end of the supporting steel frame, and the two ends of the along-cross-slope lower connecting rope are anchored on the mountain; the middle part of the along-cross-slope upper connecting rope can be anchored to the slope surface of the mountain through the sliding support in sections, and the outermost side is anchored on the mountain; the reinforcing rope passes through the sliding device at the top of the oscillating type supporting rod, and the extending-out section at the outermost side is obliquely pulled and anchored on the mountain; the metal meshes are mounted, and are connected to the along-cross-slope lower connecting rope, the along-cross-slope upper connecting rope, the reinforcing rope and the along-the-slope connecting rope through connectors, and metal meshes of adjacent modules can be connected on the same along-the-slope connecting rope 5 according to the protective needs or connected onto different along-the-slope connecting ropes; the flexible glass net is finally mounted and woven into a net shape for being hung on the supporting steel frame and the hinged support; the glass plates and the hoop type hinged piece are connected through hoop method construction; the inner flat plate hinged piece A of the hoop type hinged piece passes through the glass net supporting cable, and the end part is connected to a glass plate tightening bolt; and the inner flat plate hinged piece B of the hoop type hinged piece covers the inner flat plate hinged piece A, and the other end of the inner flat plate hinged piece A is connected to an adjacent glass plate, and then the bolt is tightened.

When the system works, large-size falling rocks are in collision and contact with the metal meshes, so that the meshes are deformed; and meanwhile, impact force is transmitted onto the along-cross-slope connecting ropes, the reinforcing rope and the traction rope; impact force is transmitted to mountain support and the supporting layer structure through the along-cross-slope connecting ropes and the traction rope, and is transmitted to a base through the supporting layer structure; and energy stored in components is transmitted to the falling rocks at a restoration stage while the falling rocks are thrown out of the system to leave the protected area. In addition, if the falling rocks are in collision with the slope surface, the slope is driven to crush the rocks and roll, so that small-size stones possibly pass through the metal meshes and drop to the flexible glass net while the glass plates can block small-size stones, and thus, the falling rocks are ensured to be prevented from damaging vehicles and pedestrians on a road. Crushed stones on the flexible glass net can be cleared regularly.

The fixing way and the connecting way are the same as those in the prior art, which is not described in detail here.

Finally, it should be noted that the above embodiments are only used to illustrate the technical solution of the present invention, but not limited thereto. Although the present invention has been described in detail with reference to the foregoing embodiments, a person of ordinary skill in the art should understand that modifications to the technical solutions described in the foregoing embodiments, or equivalent replacements of some of the technical features thereof can be made; and these modifications or replacements do not depart the essence of the corresponding technical solutions from the spirit and scope of the technical solutions of the embodiments of the present invention.

What is claimed is:

1. A combined type flexible glass net system used for protection against full-particle falling rocks on plank roads in scenic spots, comprising a supporting layer, an intercepting throwing layer and a flexible glass net isolating layer; wherein:

the supporting layer is longitudinally arranged above a protective area along a mountain, and comprises a plurality of modules each comprising a supporting steel frame and an oscillating type supporting rod, where end parts of the supporting steel frame and the oscillating type supporting rod are hinged on the mountain or a slope surface through a hinged support configured to adjust a pitch angle;

the oscillating type supporting rod is a piston rod or profile steel;

a structural form of the supporting steel frame comprises a truss structure and a profile steel structure, and an extending-out end of the supporting steel frame is fixed by a traction rope and an along-the-slope connecting rope to the mountain;

the intercepting throwing layer is supported on the supporting layer, and comprises metal mesh, an along-cross-slope lower connecting rope, an along-cross-slope upper connecting rope, a plurality of along-the-slope connecting ropes and a reinforcing rope, where the along-cross-slope lower connecting rope, the along-cross-slope upper connecting rope and the reinforcing rope are arranged parallel to the mountain; the along-cross-slope lower connecting rope, the along-cross-slope upper connecting rope and the along-the-slope connecting ropes define a supporting boundary, and the metal mesh is hung on the supporting boundary in a penetrating mode;

the along-cross-slope upper connecting rope passes through a sliding device at a top end of each along-the-slope connecting rope which is anchored to the mountain, two ends of the along-cross-slope upper connecting rope are anchored on the mountain;

a middle part of the along-cross-slope lower connecting rope passes through a sliding support on the extending-out end of the supporting steel frame of each module in sections, outermost ends of the along-cross-slope lower connecting rope are anchored to the mountain;

the reinforcing rope passes through a sliding support at a top end of each oscillating type supporting rod;

the metal mesh, the along-cross-slope upper connecting rope, the along-cross-slope lower connecting rope, the reinforcing rope and the along-the-slope connecting ropes are connected through connectors;

the flexible glass net isolating layer comprises glass plates, glass net supporting cables and hoop type hinged pieces, where the glass plates are connected to the glass net supporting cables through the hoop type hinged pieces, and the glass net supporting cables are hung below the supporting steel frame;

each hoop type hinged piece is a sleeve component with clamping mechanisms at two sides, the sleeve component is arranged on the glass net supporting cables in the penetrating mode, and the glass plates are clamped by the clamping mechanisms.

2. The combined type flexible glass net system according to claim 1, wherein the glass net supporting cables comprise a plurality of longitudinal supporting ropes and a plurality of transverse supporting ropes, first ends of the transverse supporting ropes are connected to an extending-out end of the supporting steel frames, and second ends of the transverse supporting ropes are connected to the hinged supports; and two ends of the longitudinal supporting ropes are separately connected to the transverse supporting ropes.

3. The combined type flexible glass net system according to claim 1, wherein a first end of each along-the-slope connecting rope is fixed onto a respective supporting steel frame, a middle part of each along-the-slope connecting rope is in sliding connection to a respective oscillating type supporting rod, and a second end of each along-the-slope connecting rope is connected to a respective sliding device.

4. The combined type flexible glass net system according to claim 1, wherein each hoop type hinged piece comprises an inner flat plate hinged piece and an outer flat plate hinged piece; the inner flat plate hinged piece comprises a sleeve for accommodating the glass net supporting cables and a first bolt clamping mechanism; and the outer flat plate hinged piece covers the sleeve, and is equipped with a second bolt clamping mechanism.

5. The combined type flexible glass net system according to claim 1, wherein pitch angles and overhanging lengths of the supporting steel frames and the oscillating type supporting rods are adjustable according to protective needs, and gradient adjustment of the metal mesh is realized by adjusting the pitch angle of the oscillating type supporting rods.

6. The combined type flexible glass net system according to claim 5, wherein the glass net supporting cables comprise a plurality of longitudinal supporting ropes and a plurality of transverse supporting ropes, first ends of the transverse supporting ropes are connected to the extending-out end of the supporting steel frames, and second ends of the transverse supporting ropes are connected to the hinged supports; and two ends of the longitudinal supporting ropes are separately connected to the transverse supporting ropes.

7. The combined type flexible glass net system according to claim 5, wherein a first end of each along-the-slope connecting rope is fixed onto a respective supporting steel frame, a middle part of each along-the-slope connecting rope is in sliding connection to a respective oscillating type supporting rod, and a second end of each along-the-slope connecting rope is connected to a respective sliding device.

8. The combined type flexible glass net system according to claim 5, wherein each hoop type hinged piece comprises an inner flat plate hinged piece and an outer flat plate hinged piece; the inner flat plate hinged piece comprises a sleeve for accommodating the glass net supporting cables and a first bolt clamping mechanism; and the outer flat plate hinged piece covers the sleeve, and is equipped with a second bolt clamping mechanism.

9. A method of mounting a plurality of modules of the combined type flexible glass net system according to claim 1, including the following steps:

a, constructing a supporting layer base according to general layout of the combined type flexible glass net system, and mounting the supporting steel frames and the oscillating type supporting rods, where each supporting steel frame is hinged with a pin of a respective oscillating type supporting rod, and an overhanging length and a pitch angle of a supporting layer structure are designed according to needs;

b, mounting the along-the-slope connecting ropes of the supporting steel frames, connecting a first end of the along-the-slope connecting ropes to a top end of an extending-out side of the supporting steel frames to pass through the sliding devices on an end part of the oscillating type supporting rods, anchoring a second end of the along-the-slope connecting ropes on the mountain for stabilizing and pulling the supporting layer, and sharing one along-the-slope connecting rope or two along-the-slope connecting ropes between adjacent modules according to protective needs;

c, mounting the along-cross-slope lower connecting rope, the along-cross-slope upper connecting rope and the reinforcing rope on the intercepting throwing layer, making the along-cross-slope lower connecting rope pass through the sliding device at the top end of the supporting steel frame of each module, and anchoring two ends of the along-cross-slope lower connecting rope on the mountain; anchoring a middle part of the along-cross-slope upper connecting rope on the slope surface or the mountain through the sliding support of each module in sections, and anchoring the outermost ends of the along-cross-slope upper connecting rope to the mountain; making the reinforcing rope pass through the sliding devices at the top ends of the oscillating type supporting rods, and obliquely pulling and anchoring outer-extending sections of the reinforcing rope at the outermost sides on the mountain;

d, mounting the metal mesh, connecting the metal mesh, the along-cross-slope lower connecting rope, the along-cross-slope upper connecting rope, the reinforcing rope and the along-the-slope connecting ropes through the connectors, where the metal mesh of the adjacent modules is allowed to be connected to the same along-the-slope connecting rope or connected onto different along-the-slope connecting ropes according to the protective needs; and e, mounting the flexible glass net isolating layer, weaving the glass net supporting cables into a net shape, and hanging on the supporting steel frames and the hinged supports, and connecting the glass plate to the hoop type hinged pieces through hoop method construction.

10. The mounting method according to claim 9, wherein the hoop method construction in the step e comprises: making an inner flat plate hinged piece of each hoop type hinged piece pass over a respective glass net supporting cable, and connecting an end part of the inner flat plate hinged piece to a respective glass plate, tightening a bolt; covering the inner flat plate hinged piece with an outer flat plate hinged piece of the hoop type hinged piece, connecting an end of the outer flat plate hinged part to an adjacent glass plate, and then tightening the bolt.

11. The method according to claim 9, wherein the glass net supporting cables comprise a plurality of longitudinal supporting ropes and a plurality of transverse supporting ropes, first ends of the transverse supporting ropes are connected to an extending-out end of the supporting steel frames, and second ends of the transverse supporting ropes are connected to the hinged supports; and two ends of the longitudinal supporting ropes are separately connected to the transverse supporting ropes.

* * * * *